United States Patent [19]

Ishikawa et al.

[11] Patent Number: 4,963,467

[45] Date of Patent: Oct. 16, 1990

[54] SILVER HALIDE PHOTOGRAPHIC EMULSION

[75] Inventors: Sadayasu Ishikawa; Masaru Tsukamoto; Toshihiko Yagi, all of Tokyo, Japan

[73] Assignee: Konica Corporation, Tokyo, Japan

[21] Appl. No.: 216,142

[22] Filed: Jul. 7, 1988

[30] Foreign Application Priority Data

Jul. 15, 1987 [JP] Japan ..... 62-176700

[51] Int. Cl.[5] ..... G03C 1/005

[52] U.S. Cl. ..... 430/567; 430/569

[58] Field of Search ..... 430/567, 569

[56] References Cited

U.S. PATENT DOCUMENTS 4,668,614 5/1987 Takada et al. ..... 430/567
4,686,178 8/1987 Honda et al. ..... 430/569
4,713,318 12/1987 Sugimoto et al. .
4,728,602 3/1988 Shibahara et al. ..... 430/567

FOREIGN PATENT DOCUMENTS 0147868 10/1985 European Pat. Off. .

OTHER PUBLICATIONS

Abstract 59-178447(A)-1 pg.

*Primary Examiner*—Paul R. Michl
*Assistant Examiner*—Janet C. Baxter
*Attorney, Agent, or Firm*—Jordan B. Bierman

[57] ABSTRACT

A silver halide photographic emulsion is disclosed. The emulsion contains core/shell type silver halide grain comprising a core essentially consisting of silver iodobromide and at least one shell essentially consisting of silver iodobromide or silver bromide, in which said silver halide emulsion have an average silver iodide content of less than 7 mol %, and said core has a silver iodide content of not less than 10 mol % a shell arranged at the outermost portion of said shell has a silver iodide content of not more than 5 mol %, and said core and shell have a distinct core/shell structure. The emulsion is excellent in developing activity, ready in contrast control and excellent in processing stability, with out deteriorating both sensitivity and pressure resistance property.

12 Claims, No Drawings

SILVER HALIDE PHOTOGRAPHIC EMULSION

FIELD OF THE INVENTION

This invention relates to a novel silver halide emulsion and more particularly to a silver halide emulsion which is excellent in development activity, gamma and processing stability.

BACKGROUND OF THE INVENTION

In recent years, there have been increasing demands for the characteristics of photographic silver halide emulsions and, in particular, the demands have been highly leveled up for the photographic characteristics such as high sensitivity, low fogging and high gamma.

It has become essential to provide stable photographic characteristics against the variations in photographic conditions. In particular, it has been strongly demanded to make both sensitivity and contrast stable against the variations of various factors required in processing steps, such as the quantity of light-sensitive materials to be processed, the amount of a developer to be replenished, a temperature of the developer to be used and a processing time to be taken.

To meet these demands, there have been the proposals for highly sensitive emulsions having a high silver iodide content inside of the grains and a distinct core/-shell structure in the grains thereof. These proposals were disclosed in, for example, Japanese Patent Publication Open to Public Inspection (hereinafter referred to as Japanese Patent O.P.I. Publication) Nos. 143331-1985, 3247-1987 and 7039-1987.

With these emulsions, the developability thereof are not so good because a total average of silver iodide contents is relatively high and the contrasts may hardly be controlled within a certain developing time. Besides the above, there has also been a proposal for a silver halide emulsion in which a total average of silver iodide contents is lowered by reducing the silver iodide content of each core as the distinct core/shell structure remains unchanged. This proposal was disclosed in one of the examples given in Japanese Patent O.P.I. Publication No. 143331-1985. However, this emulsion deteriorates its pressure resistance property, though its development activity may be improved.

On the other hand, Japanese Patent O.P.I. Publication Nos. 35726-1985 and 147727-1985 disclose the technologies in which a high silver iodide content is provided to the cores of core/shell emulsion grains so as to reduce the total average silver iodide content of the emulsion. However, this emulsion has not any distinct core/shell-structure and, therefore, a high sensitization may hardly be achieved.

In the conventional technologies, as mentioned above, it has been difficult to materialize a silver halide emulsion which is excellent in development activity and ready in contrast control, without detriorating both sensitivity and pressure resistance property.

SUMMARY OF THE INVENTION

It is, therefore, an object of the invention to provide a silver halide photographic emulsion which is excellent in development activity, ready in contrast control and excellent in processing stability, without deteriorating both sensitivity and pressure resistance property.

Namely, the inventors have discovered to enable them to achieve the objects of the invention with silver halide emulsion comprising core/shell type silver halide grains comprising a core essentially consisting of silver bromoiodide and at least one shell essentially consisting of silver iodobromide or silver bromide, wherein an average silver iodide content of the emulsion is less than 7 mol % and the cores have a silver iodide content of not less than 10 mol % and the shell arranged at the outermost portion of the shell has a silver iodide content of not more than 5 mol % and further both of the cores and shells have a distinct core/shell structure.

DETAILED DESCRIPTION OF THE INVENTION

The silver halide photographic emulsions of the invention contain core/shell type grain having a core comprising silver essentially consisting of iodobromide and at least one shell essentially consisting of silver iodobromide or silver bromide.

Each of the core/shell type grains which are to be contained in the emulsions of the invention is comprised of both of a core for serving as the nucleus of the grain and a shell for covering the core, and the shell is formed into one or more layers. It is preferable that the silver iodide contents of both cores and shells should be different from each other and, it is particularly preferable that the grains should be so formed as to make the silver iodide contents of the cores be the highest comprising to those of the other portions of the grains.

In the invention, the above-mentioned cores are to have a silver iodide content of not less than 10 mol %, however, preferably from 10 to 40 mol %, more preferably from 15 to 40 mol % and particularly from 20 to 40 mol %. Among the above-mentioned shells, a shell arranged to the outermost side, i.e., the outermost surface shell, is to have a silver iodide content of not more than 5 mol %, however, preferably less than 4 mol % and more preferably from 0 to 2.0 mol %.

A core proportion to the whole body of a grain should be desirably from 2 to 60% and more preferably from 5 to 50%.

In the silver halide grains of the invention, when the silver iodide content of the core and that of the shell are different from each other, it is preferable to provide a sharp interface between the core portion having a high silver iodide content and the shell portion having a low silver iodide content. It is also preferable to interpose, between the core and shell, at least one intermediate layer having a silver iodide content which is medium between those of the cores and the outermost surface shell.

When an emulsion of the invention is comprised of the core/shell type silver halide grains having the above-mentioned intermediate layer, the preferable proportion by volume of the intermediate layer should be from 1 to 30% of the whole grains and more preferably from 5 to 20% thereof.

The differences of silver iodide contents both between a shell and the intermediate layer and between the intermediate layer and the core should be preferably not less than 3 mol %, respectively, and the difference of silver iodide contents between the core and a shell should be not less than 10 mol %.

In the silver halide photographic emulsions of the invention, the average silver iodide content thereof is to be 5 less than 7 mol %, preferably not more than 6 mol %, more preferably less than 5 mol % and most preferably from 0.5 to 4 mol %.

As mentioned above, the emulsions of the invention are to be those mainly containing silver iodobromide. It is, however, allowed to contain silver halides having the other composition such as silver chloride, provided that the advantages of the invention may not be spoiled.

When a core/shell type silver halide grain is grown initially from a seed grain, as disclosed in Japanese Patent O.P.I. Publication Nos. 177535-1984 and 138538-1985, there may be some instances where some area in the center of the grain may have a halide composition different from that of the core of the grain. If this is the case, for the halide compositions of the seed grain, it is allowed to use any silver halide compositions such as silver bromide, silver iodo- bromide, siler chloroiodobromide, silver chlorobromide, silver chloride and so forth. It is, however, preferable to use silver iodobromide having a silver iodide content of not more than 10 mol %, or silver bromide.

A seed emulsion proportion should be preferably not more than 50% of the whole silver halide and particularly not more than 10% thereof.

In the above-mentioned core/shell type silver halide grains, a silver iodide distribution may be detected in various physical measurement methods. For example, the detection may be made in such a low-temperature luminescence measurement method or an X-ray diffractometry as described in The Abstracts of the Lectures given at 1981 Annual Convention of Society of Photographic Science and Technology of Japan.

The core/shell type grains contained in the emulsions of the invention each have a distinct core/shell structure in which a core and a shell are distinct from each other. The term, a distinct core/shell structure used herein, means a structure capable of providing a diffraction curve having at least two peaks corresponding to the core and shell, respectively, within the range of diffraction angles ($2\theta$) of from 71 to 74 degrees, such diffraction angles are measured in the undermentioned X-ray diffractometry.

Namely, in silver halide grains having a distinct core/shell structure, which are aplicable to the emulsions of the invention, the structure thereof may be measured in an X-ray diffractometry.

When a diffraction pattern of the (420) face of a silver halide is measured in a powder-radiography at a tube voltage of 40 KV and a tube current of 100 mA, by making use of Cu as a target and K$\alpha$ rays of Cu as a radiation source, there may be obtained a diffraction curve having at least two peaks corresponding to a core and a shell respectively within the range of diffraction angles ($2\theta$) of from 71 to 74 degrees, provided that the emulsion grains have a distinct core/shell structure. The expression, a diffraction curve has two peaks used herein, means that a ratio of the lowest intensity between the peaks to a intensity of the lowerst peak is to be not higher than 0.9. The value of this ratio is preferably, not higher than 0.7. When comparing the two peak intensities, the peak intensity corresponding to a core should be preferably from 1/20 to 1/1 of the diffraction peak intensity corresponding to a shell and more preferably from 1/15 to ½ thereof.

It has been described before that, in the silver halide emulsion grains of the invention, each of the grains thereof may sometimes be provided between the core of a grain and the shell of the outermost layer of the grain with an intermediate layer having an iodide content different from those of the core and the shell of the outermost layer of the grain. However, this description means that, if such an intermediate layer is provided and an X-ray diffraction pattern is obtained, the intermediate layer should be provided so as not to substantially affect the forms of the two peaks respectively corresponding to a high iodide containing portion and a low iodide containing portion. In other words, this description means that a grain has a core portion having a high iodide content, an intermediate layer and the shell portion of the outermost layer and at least two peaks appear to correspond to the core and the shell and, further, the lowest intensity between the peaks should be in a ratio of not higher than 0.9 to the minimum peak intencity. When comparing the intencity of the two peaks with each other, a ratio of the peak intencity of the core to the diffraction peak intensity of the shell should be preferably from 1/20 to 1/1 and more preferably from 1/15 to ½. Such a silver halide grain is a grain substantially having a distinct two-layered structure.

The core/shell type silver halide grains relating to the invention may be in any crystal forms including normal crystal forms such as a cube, a tetradecahedron and an octahedron, twinned crystal forms, and the mixtures thereof. However, the normal crystal forms should be preferred.

The configurations of grains after they were formed are as mentioned above. It is preferred that, in the course of forming the grains and even after each layer was formed, the configuration of the grains should be made as same as those after the grains were formed. It is further preferred that the configurations thereof should be the same in the whole step of forming the grains, (Hereinafter this phenomenon will be referred to as that 'grains have the same hysteresis of crystal habit.')

From the silver halide emulsions of the invention, any unnecessary soluble salts may be removed after silver halide grains were grown up. Or, in the emulsions of the invention, the soluble salts may be contained as they are.

When removing such salts, it is allowed to follow the methods described in, for example, Research Disclosure, No. 17643, Chapter II. To be more concrete, in order to remove soluble salts from an emulsion which was precipitated or physically ripened, it is allowed to apply a noodle-washing method to remove them by making gelatin gelled, or to apply a flocculation method to remove them by utilizing an inorganic salt, an anionic surfactant, an anionic polymer such as polystyrenesulfonic acid, or a gelatin derivative such as an acylated gelatin, a carbamoylated gelatin and so forth. In particular, a flocculation-sedimentation method using an inorganic salt and an anionic surfactant should preferably be applied as a desalting method which may be carried out after cores were prepared in the course of manufacturing the emulsions of the invention.

In the silver halide emulsions of the invention, a distinct core/shell structure may be completed in such a manner that, after the cores are prepared, salts remaining in the emulsions are thoroughly removed by washing them with water and the shells are then grown up. This procedure is particularly important to the practical emulsion preparation. In other words, if shells are grown up without removing any salts still remaining in an emulsion after cores were prepared, it is usually hard to prepare a silver halide emulsion having a distinct core/shell structure of the invention.

After washing the salts away with water and while shells are being grown, the concentration of the salts brought in from a core emulsion should be preferably not more than 1/10 of the concentration of the salts still remaining after the core emulsion is prepared, more preferably not more than 1/100 and, most preferably not more than 1/500.

While silver halide grains are being grown, it is allowed to make present such a well-known silver halide solvent as ammonia, thioether, thiourea and so forth.

In the courses of forming and/or growing silver halide grains, at least one kind of metal salts selected from the group consisting of a cadmium salt, a zinc salt, a lead salt, a thallium salt, an iridium salt including the complex salts thereof, a rhodium salt including the complex salts thereof and an iron salt including the complex salts thereof is used to add the metal ion thereof into the silver halide grains, so that these metal elements are contained in the inside of the grains and/or to the surfaces of the grains. Further, reduction-sensitization nuclei may be provided into the inside of the grains and/or to the surfaces thereof by putting the grains in a suitable reducible atmosphere.

The silver halide grains may be those forming a latent image mainly either on the surface thereof or in the inside thereof. The silver halide grains are from 0.05 to 5.0 μm in size and preferably from 0.1 to 3.0 μm.

The silver halide photographic emulsions of the invention should preferably be a monodisperse type emulsion having a narrow grain-size distribution. Any polydisperse type emulsions having a broard grain-size distribution cannot generally be the distinct core/shell type emulsions of the invention.

Of the silver halide grains of a monodisperse type silver halide emulsion, the silver halide grains having a grain size within the range of ±20% with respect to an average grain-size $\bar{r}$ should be preferably contained in a proportion of not less than 60% by weight of the whole silver halide grains, more preferably not less than 70% by weight and particularly not less than 80% by weight thereof.

Herein, an average grain size $\bar{r}$ is defined as a grain size ri obtained when maximizing a product, $ni \times ri^3$, in which ni represents the frequency of the grains having a grain-size ri, and the significant figures are 3 and, in the lowest figure, the fraction of 0.5 and over is counted as a unit and the rest is cut away.

The expression, 'grain size' used herein, means a diameter in the case of a spherical-shaped silver halide grain, or a diameter of a circular image having the same area as that converted from the area of the projective image of a grain in the case that the grain is in the other shapes than the spherical-shape.

The grain sizes may be obtained in such a manner, for example, that the grains are photographed after they are magnified ten thousand to fifty thousand times with an electron microscope and the grain diameters or the projective areas are measured, provided that the grains to be measured should be not less than 1000 in number at random.

When a grain distribution is defined by the following formula, $$\frac{\text{Standard deviation}}{\text{Average grain size}} \times 100 = \text{Distribution (\%)},$$

the grain distribution of the particularly preferable high grade monodisperse type emulsions of the invention is not more than 20% and more preferably not more than 15%.

An average grain size and a standard deviation are to be obtained from the above-defined grain size ri.

A monodisperse type emulsion may be prepared in such a manner that a water-soluble silver salt solution and a water-soluble halide solution are added in a seed-grain-containing gelatin solution in a double-jet method, with controlling the pAg and pH. For determining the rate of adding the solutions may be referred to Japanese Patent O.P.I. Publication Nos. 48521-1979 and 49938-1983.

The high-grade monodisperse type emulsions may be prepared by applying a method of growing the grains of an emulsion in the presence of tetrazaindene. This method is disclosed in Japanese Patent O.P.I. Publication No. 122935-1985.

The silver halide emulsions of the invention may be chemically sensitized in an ordinary method.

The silver halide emulsions of the invention may be optically sensitized to any desired wavelength regions by making use of a dye which is well-known in the photographic industry as a sensitizing dye. Such sensitizing dyes may be used independently or in combination.

EXAMPLES

Next, the invention will be described more in detail with reference to the samples given below. It is, however, to be understood that the invention shall not be limited thereto.

EXAMPLE-1

A silver iodobromide emulsion containing 2.0 mol % of silver iodide was prepared by the double-jet method under the conditions at 40° C., pH 8.0 and pAg 9.0. The resulted emulsion was washed with water to remove excessive salts therefrom. In the resulted emulsion, the average grain size was 0.27 μm and the grain size distribution, i.e., the standard deviation/the average grain size, was 12.0%. This emulsion was further processed to contain silver in an amount equivalent to 1200 g of silver nitrate so as to use as seed-crystal emulsion [A]. The amount of the seed crystals [A] prepared was 4160 g.

Seed crystals [A] of 1510 g were dissolved in 8 liters of an aqueous 1% gelatin solution with keeping a temperature at 40° C., and then 0.4N-rated aqueous ammonia was added, and stirred. To the solution, 250 cc out of 2.39 liters of an aqueous solution dissolved therein with 849 g of silver nitrate were added by taking 10 minutes. The pAg and pH of the resulted solution were then adjusted to be 7.1 and 9.9, respectively. Successively, the silver nitrate solution and 2.14 liters of an aqueous 1% gelatin solution dissolved therein with both 367 g of potassium bromide and 224 g of potassium iodide were supplied at an adding rate without causing any formation of new crystal nucleus. Thus, a core emulsion containing 30 mol % of silver iodide was prepared. After the solutions were added completely, the pH of the emulsion was reduced to 6.0 with keeping a temperature at 40° C. and was then washed with water so as to remove excessive salts.

In the washing step, 500 cc of a solution of 5% Demol (manufactured by Kao-Atlas Company) were added to 16 liters of the core emulsion with stirring. After the solution was stirred for three minutes, it was allowed to stand for five minutes so that the emulsion was flocculated and sedimented. Thereafter, 14.9 liters of the supernatant liquid not containing any emulsion were removed by means of decantation. To the remaining emulsion, 8 liters of pure water warmed up to 40° C. were added, and they were stirred for four minutes. Then, 500 cc of a 20% magnesium sulfate solution were added and further stirred for three minutes, and then stopped to stirr. The resulted solution was allowed to stand for five minutes to flocculate and sediment the emulsion. 85 liters of the supernatant liquid not containing any emulsion was removed by means of decantation. To the remaining emulsion, 8 liters of pure water wamed up to 40° C. were added. The above-mentioned procedures were repeated and then 1.6 liters of a 8% gelatin solution and a small amount of an antiseptic were added.

The emulsion obtained was an octahedral emulsion that contained octahedral grains. The average grain size and grain size distribution thereof were 0.378 μm and 12.3%, respectively. This emulsion is named Core Emulsion [B]. The amount of Core Emulsion [B] prepared was 4160 g and the salt concentration was 1/1290 of that of the core emulsion prepared.

Next, 817 g of Core Emulsion [B] were dissolved in 8.6 liters of an aqueous 1% gelatin solution kept at 40° C. Then, 0.61N-rated aqueous ammonia was added, and stirred. To the resulted solution, both 2.7 liters of an aqueous solution of 965 g of silver nitrate and 2.7 liters of an aqueous 1% gelatin solution of 623 g of potassium bromide were added by taking 30 minutes. The pAg and pH of the resulted solution which was in the course of the above-mentioned additions were so controlled as to be 9.7 and 8.8 at the beginning of the additions and 10.5 and 8.0 at the completion of the additions, respectively, so that the silver bromide shells were prepared on the cores. Thus obtained emulsion was washed with water in the same manner as in Core Emulsion [B] and the resulted emulsion was named Emulsion [1]. Emulsion [1] was an octahedral emulsion containing a total of 4.0 mol % of silver iodide. The average grain size, the grain size distribution and the amount prepared were 0.65 μm, 14.0% and 4160 g, respectively.

Further, 2083 g of Seed Crystal [A] were dissolved in 8 liters of an aqueous 1% gelatin solution kept at 40° C. and Core Emulsion [C] was prepared in the same manner as in Core Emulsion [B]. The resulted emulsion was in the octahedral form. The average grain size, the grain size distribution and the amount prepared were 0.34 μm, 12.1% and 4160 g, respectively, and the salt concentration was 1/1290 of that of the core emulsion prepared. Still further, 595 g of Core Emulsion [C] were dissolved in 8.6 liters of an aqueous 1% gelatin solution kept at 40° C. Thereto, 2.88 liters of an aqueous solution containing 1028 g of silver nitrate and 2.88 liters of an aqueous 1% gelatin solution containing 716 g of potassium bromide and 5 g of potassium iodide were supplied in the same manner as in Emulsion [1] so as to prepare shells. Thus, Emulsion [2] containing a total of 4.0 mol % of silver iodide was prepared. The obtained emulsion was in the octahedral form. The average grain size, the grain size distribution and the amount prepared were 0.65 μm, 14.0% and 4160 g, respectively.

Emulsions [3] and [5] were prepared in such a manner that the core grain sizes were changed in the same manner as in Core Emulsion [B] and the silver bromide shells were grown up in the same manner as in Emulsion [1]. Emulsion [3] was an octahedral emulsion containing a total of 2.0 mol % of silver iodide and having an average grain size of 0.65 μm and a grain size distribution of 14.0%. Emulsion [5] was an octahedral emulsion containing a total of 6.2 mol % of silver iodide and having an average grain size of 0.65 μm and a grain size distribution of 13.0%.

Emulsions [4] and [6] were prepared in such a manner that the core grain sizes were changed in the same manner as in Core Emulsion [C] and the silver iodobromide shells were grown up in the same manner as in Emulsion [2]. Emulsion [4] was an octahedral emulsion containing a total of 2.0 mol % of silver iodide and having an average grain size of 0.65 μm and a grain size distribution of 14.0%. Emulsion [6] was an octahedral emulsion containing a total of 6.2 mol % of silver iodide and having an average grain size of 0.65 μm and a grain size distribution of 14.0%.

Now, the examples of the preparation of the comparative emulsions will be described.

For the purpose of leveling off the difference in sensitometric evaluations between the comparative emulsions and the emulsions of the invention, the preparation conditions of the comparative emulsions were so adjusted as to make the grain sizes be the same as those of the emulsions of the invention.

Following the method disclosed in Japanese Patent O.P.I. Publication No. 143331-1985, the cores containing 20 mol % of silver iodide were prepared and the silver bromide shells were then grown up, so that Emulsion [7] containing a total of 10.0 mol % of silver iodide was prepared.

Similarly, following the method disclosed in Japanese Patent O.P.I. Publication No. 143331-1985, the cores containing 6 mol % of silver iodide were prepared and the silver bromide shells were then grown up, so that Emulsion [8] containing a total of 2.0 mol % of silver iodide was prepared.

Further, following the method disclosed in Japanese Patent O.P.I. Publication No. 147727-1985, the cores containing 40 mol % of silver iodide were prepared and the silver bromide shells were then grown up, so that Emulsion [9] containing a total of 3.0 mol % of silver iodide was prepared.

Similarly, following the method disclosed in Japanese Patent O.P.I. Publication No. 147727-1985, cores each containing 40 mol % of silver iodide were prepared and silver bromide shells were then grown up, so that Emulsion [10] containing a total of 10.0 mol % of silver iodide was prepared.

Following the method disclosed in Japanese Patent O.P.I. Publication No. 178447-1984, cores each containing 30 mol % of silver iodide were prepared and silver bromide shells were then grown up, so that Emulsion [11] containing a total of 2.0 mol % of silver iodide was prepared.

Following the method disclosed in Japanese Patent O.P.I. Publication No. 143331-1985, cores each containing 30 mol % of silver iodide were prepared and silver bromide shells were then grown up, so that Emulsion [12] containing a total of 2.0 mol % of silver iodide was prepared.

Further, following the method disclosed in Japanese Patent O.P.I. Publication No. 99433-1984, cores each containing 30 mol % of silver iodide were prepared and silver bromide shells were then grown up, so that Emulsion [13] containing a total of 2.0 mol % of silver iodide was prepared.

The structures of the above 13 kinds of emulsions thus prepared are collectively shown in Table 1.

TABLE 1

| Emulsion (Inventive or comparative) | Formulated silver iodide content (mol %) (Core) | (Shell) | Total AgI content (mol %) | Distinct core/shell structure | Average grain size (μm) | Grain size distribution (%) |
|---|---|---|---|---|---|---|
| 1 (Inventive) | 30 | 0 | 4.0 | Yes | 0.65 | 14.0 |
| 2 (Inventive) | 30 | 0.5 | 4.0 | Yes | 0.65 | 14.0 |
| 3 (Inventive) | 30 | 0 | 2.0 | Yes | 0.65 | 14.0 |
| 4 (Inventive) | 30 | 0.5 | 2.0 | Yes | 0.65 | 14.0 |
| 5 (Inventive) | 30 | 0 | 6.2 | Yes | 0.65 | 13.0 |
| 6 (Inventive) | 30 | 0.5 | 6.2 | Yes | 0.65 | 14.0 |
| 7 (Comparative) | 42 | 0 | 14.0 | Yes | 0.65 | 25.0 |
| 8 (Comparative) | 6 | 0 | 2.0 | Yes | 0.68 | 24.0 |
| 9 (Comparative) | 40 | 0 | 3.0 | None | 0.66 | 24.0 |
| 10 (Comparative) | 40 | 0 | 10.0 | None | 0.66 | 24.0 |
| 11 (Comparative) | 30 | 0 | 2.0 | None | 0.65 | 15.0 |
| 12 (Comparative) | 30 | 0 | 2.0 | Yes | 0.67 | 30.0 |
| 13 (Comparative) | 30 | 0 | 2.0 | None | 0.66 | 40.0 |

In the column of the distinct core/shell structure of Table 1, an indication, 'Yes', represents that two diffraction peaks corresponding to a core and a shell are shown at a diffraction angle ($2\theta$) within the range of from 71° to 74° in the aforementioned powder X-ray diffractometry, and an indication, 'None', represents the other cases than the above. In Emulsions [1] through [7] and Emulsion [12], the double-peak of a core and a shell were apparently found. In Emulsion [8], two diffraction peaks were found, though the peaks were considerably close to each other.

In Emulsions [9], [10], [11] and [13], on the other hand, only one diffraction peak was found. From this fact, it may be judged that Emulsions [9], [10], [11] and [13] have no core/shell structure without doubt.

The above-mentioned 13 kinds of the emulsions were gold-sulfur-sensitized by adding ammonium thiocyanate, a chloroaurate and hypo, respectively. Further, to each emulsion, 4-hydroxy-6-methyl-1,3,3a,7-tetrazaindene was added and the ordinary photographic additives such as a spreading agent, a thickening agent, a hardening agent and so forth were then added. The resulted emulsions were coated in an ordinary method respectively onto a subbed polyethyleneterephthalate film base so that silver may be contained in an amount of 50 mg per 100 $cm^2$, and dried up. Thus, the samples for sensitometric evaluation use were prepared, respectively. In the sensitometric evaluation thereof, an exposure was made to a light source having a color temperature of 5400° K., through an optical wedge, for 1/100 of a second. The exposure quantity was 3.2 CMS.

Next, the following processing steps were carried out.

| (Processing step) | (At 35° C.) | (Processing time) |
|---|---|---|
| 1. Developing | | 30 sec. |
| 2. Fixing | | 21 sec. |
| 3. Washing | | 14 sec. |

-continued

| (Processing step) | (At 35° C.) | (Processing time) |
|---|---|---|
| 4. Drying | | |

[Developer]

Potassium sulfite, anhydrous: 50 g
Hydroquinone: 10 g
Boric acid, anhydrous: 1 g
Potassium carbonate, monohydrate: 15 g
1-phenyl-3-pyrazolidone: 0.5 g
Potassium hydroxide: 4 g
5-methyl-benzotriazole: 0.05 g
Potassium bromide: 5 g
Glutaraldehyde bisulfite: 15 g
Glacial acetic acid: 8 cc
Add water to make: 1 liter

[Fixer]

Water (at about 50° C.): 600 ml
Sodium thiosulfate: 240 g
Sodium sulfite, anhydrous: 15 g
Glacial acetic acid: 13.4 ml
Boric acid: 7.5 g
Potassium alum: 15 g
Add water to make: 1 liter Table 2 shows the results of the photographic characteristics of the samples prepared.

TABLE 2

| Sample (Inventive or comparative) | Gamma | Relative sensitivity* | Pressure-resistance** (ΔD) |
|---|---|---|---|
| 1 (Inventive) | 1.36 | 100 | 0.06 |
| 2 (Inventive) | 1.35 | 105 | 0.07 |
| 3 (Inventive) | 1.38 | 99 | 0.08 |
| 4 | 1.32 | 101 | 0.08 |

TABLE 2-continued

| Sample (Inventive or comparative) | Gamma | Relative sensitivity* | Pressure-resistance** (ΔD) |
|---|---|---|---|
| (Inventive) 5 | 1.28 | 100 | 0.06 |
| (Inventive) 6 | 1.27 | 101 | 0.07 |
| (Inventive) 7 | 0.94 | 90 | 0.10 |
| (Comparative) 8 | 0.95 | 71 | 0.41 |
| (Comparative) 9 | 0.99 | 80 | 0.11 |
| (Comparative) 10 | 0.82 | 82 | 0.14 |
| (Comparative) 11 | 0.99 | 92 | 0.14 |
| (Comparative) 12 | 1.02 | 90 | 0.12 |
| (Comparative) 13 | 0.98 | 84 | 0.16 |
| (Comparative) | | | |

*Relative sensitivity: The sensitivity of Sample 1 was regarded as a relative value of 100 and those of the other samples were shown by the values relative thereto.
**Pressure resistance test: An emulsion side was folded inside at a constant speed and the above-mentioned development was carried out. In the resulted samples, the density difference (Dp-Dg) between a density (Dp) in the area darkened by folding and the ground density (Dg) was obtained. The results were shown in terms of ΔD in this table.

As is obvious from the results shown in Table 2, in Samples 1 through 6 of the invention, the high gamma values were obtained without deteriorating any sensitivity and pressure resistance.

EXAMPLE-2

With respect to Samples 1 through 10, the developing temperature was changed to 35° C.±3° C. and they were processed as mentioned above. The resulted processing temperature dependency of each sample was evaluated. The results thereof are shown in Table 3.

TABLE 3

| Sample (Inv. or Comp.) | Prcs. temp., 32° C. Fog | Rel. sens. | Gamma | Prcs. temp., 35° C. Fog | Rel. sens. | Gamma | Prcs. temp., 38° C. Fog | Rel. sens. | Gamma |
|---|---|---|---|---|---|---|---|---|---|
| 1 (Inv.) | 0.03 | 98 | 1.35 | 0.03 | 100 | 1.36 | 0.04 | 103 | 1.37 |
| 2 (Inv.) | 0.03 | 102 | 1.34 | 0.03 | 105 | 1.35 | 0.04 | 106 | 1.36 |
| 3 (Inv.) | 0.03 | 98 | 1.36 | 0.03 | 99 | 1.38 | 0.04 | 103 | 1.39 |
| 4 (Inv.) | 0.03 | 100 | 1.30 | 0.03 | 101 | 1.32 | 0.04 | 104 | 1.34 |
| 5 (Inv.) | 0.03 | 94 | 1.24 | 0.04 | 100 | 1.28 | 0.05 | 102 | 1.28 |
| 6 (Inv.) | 0.04 | 95 | 1.23 | 0.05 | 101 | 1.27 | 0.06 | 103 | 1.29 |
| 7 (Comp.) | 0.09 | 87 | 0.70 | 0.15 | 90 | 0.94 | 0.20 | 93 | 0.96 |
| 8 (Comp.) | 0.02 | 61 | 0.81 | 0.04 | 71 | 0.95 | 0.07 | 80 | 1.00 |
| 9 (Comp.) | 0.02 | 71 | 0.76 | 0.04 | 80 | 0.99 | 0.07 | 94 | 1.10 |
| 10 (Comp.) | 0.02 | 64 | 0.60 | 0.05 | 82 | 0.82 | 0.09 | 90 | 0.95 |
| 11 (Comp.) | 0.02 | 90 | 0.93 | 0.03 | 92 | 0.99 | 0.04 | 98 | 1.16 |
| 12 (Comp.) | 0.03 | 87 | 0.96 | 0.04 | 90 | 1.02 | 0.05 | 96 | 1.18 |
| 13 (Comp.) | 0.03 | 79 | 0.92 | 0.05 | 84 | 0.98 | 0.07 | 90 | 1.12 |

As is obvious from the results shown in Table 3, the following facts were found. Namely, In the comparative samples, the characteristic variations thereof were seriously affected by the processing temperature variations. In Samples 1 through 6 of the invention, the dependencies of fogginess, sensitivity and gamma upon processing temperature were relatively a little and the processing stability was improved. Further, in Samples 1 through 6, a high sensitivity and a high gamma can be obtained even at a processing temperature of 32° C. From these facts, it is, therefore, understood that the photographic emulsions of the invention are excellent in development activity.

Furthermore, the contrasts of the emulsions of the invention may readily be controlled when preparing them, because the gamma values thereof are stable regardless of processing temperatures.

As described above, the silver halide photographic emulsions of the invention are excellent in development activity, ready in controlling contrasts and also excellent in processing stability, without deteriorating any sensitivity and pressure resistance.

What is claimed is:

1. A silver halide photographic emulsion containing core/shell type silver halide grains, said grains comprising a core consisting essentially of silver iodobromide, and at least one shell consisting essentially of silver iodobromide or silver bromide, said emulsion having an average silver iodide content of less than 7 mol %, said core having a silver iodide content of not less than 10 mol %, and an outermost shell having an iodide content of not more than 5 mol % wherein, said grains provide an X-ray diffraction pattern having at least two peaks, corresponding to said core and said outermost shell, respectively, with a diffraction angle 2 $\theta$ of between 71° and 74° when a diffraction pattern of a (420) face of said grains is measured using a powder X-ray diffraction method with K$\alpha$ rays of Cu, and a ratio of the lowest intensity between said peaks to the highest intensity of the lowest peak of said peaks of 0.7 or less.

2. The emulsion of claim 1, wherein said core has a silver iodide content of from 10 mol % to 40 mol %.

3. The emulsion of claim 2, wherein said core has a silver iodide content of from 15 mol % to 40 mol %.

4. The emulsion of claim 2, wherein said core has a silver iodide content of from 20 mol % to 40 mol %.

5. The emulsion of claim 1, wherein said shell arranged to the outermost portion has a silver halide content of less than 4 mol %.

6. The emulsion of claim 5, wherein said shell arranged at the outermost portion has a silver halide content of from 0 to 2.0 mol %.

7. The emulsion of claim 1, wherein said average silver iodide content is not more than 6.0 mol %.

8. The emulsion of claim 7, wherein said average silver iodide content is not more than 5.0 mol %.

9. The emulsion of claim 8, wherein said average silver iodide content is from 0.5 to 4 mol %.

10. The emulsion of claim 1, wherein a ratio of an intensity of said peak corresponding to the core to an intensity of said peak corresponding to the shell is from 1/20 to 1/1.

11. The emulsion of claim 10, wherein a ratio of an intensity of said peak corresponding to the core to an intensity of said peak corresponding to the shell is from 1/15 to $\frac{1}{2}$.

12. The emulsion of claim 1 wherein at least 60% of said grains have a grain size in the range of ±20% of an average grain size $\bar{r}$.

* * * * *